US009376940B2

(12) United States Patent
Fischer et al.

(10) Patent No.: US 9,376,940 B2
(45) Date of Patent: Jun. 28, 2016

(54) CAMSHAFT PHASER

(71) Applicant: DELPHI TECHNOLOGIES, INC., Troy, MI (US)

(72) Inventors: Thomas H. Fischer, Rochester, NY (US); Karl J. Haltiner, Jr., Fairport, NY (US)

(73) Assignee: Delphi Technologies, Inc., Troy, MI (US)

( * ) Notice: Subject to any disclaimer, the term of this patent is extended or adjusted under 35 U.S.C. 154(b) by 34 days.

(21) Appl. No.: 14/539,276

(22) Filed: Nov. 12, 2014

(65) Prior Publication Data

US 2016/0130989 A1 May 12, 2016

(51) Int. Cl.
*F01L 1/34* (2006.01)
*F01L 1/344* (2006.01)

(52) U.S. Cl.
CPC ..... *F01L 1/3442* (2013.01); *F01L 2001/34433* (2013.01); *F01L 2001/34456* (2013.01); *F01L 2001/34483* (2013.01)

(58) Field of Classification Search
CPC ..... F01L 2001/34433; F01L 2001/34456; F01L 2001/34483
USPC ..... 123/90.17
See application file for complete search history.

(56) References Cited

U.S. PATENT DOCUMENTS

| | | | | |
|---|---|---|---|---|
| 5,367,992 | A | 11/1994 | Butterfield et al. | |
| 6,799,544 | B1 | 10/2004 | Pierik | |
| 6,932,038 | B2 | 8/2005 | Pierik | |
| 7,000,580 | B1 | 2/2006 | Smith et al. | |
| 7,182,053 | B2 | 2/2007 | Meintschel et al. | |
| 8,534,246 | B2 | 9/2013 | Lichti et al. | |
| 2005/0066923 | A1 | 3/2005 | Yaoko et al. | |
| 2010/0175650 | A1 * | 7/2010 | Suzuki | F01L 1/022 123/90.17 |

FOREIGN PATENT DOCUMENTS

| | | | |
|---|---|---|---|
| DE | 102011056264 | A1 | 6/2013 |
| JP | 2007138725 | A1 | 6/2007 |

* cited by examiner

*Primary Examiner* — Zelalem Eshete
(74) *Attorney, Agent, or Firm* — Joshua M Haines

(57) ABSTRACT

A camshaft phaser includes a stator having a plurality of lobes; a rotor coaxially disposed within the stator and having a plurality of vanes interspersed with the lobes defining advance chambers and retard chambers; a camshaft phaser attachment bolt for attaching the camshaft phaser to a camshaft, the camshaft phaser attachment bolt defining a valve bore that is coaxial with the stator. A supply passage extends radially outward from the valve bore and includes a downstream end that is proximal to the valve bore and an upstream end that is distal from the valve bore and separated from the downstream end by a check valve seat. A check valve member in the supply passage is biased toward the check valve seat by centrifugal force. A valve spool is moveable within the valve bore such that the valve spool directs oil that has passed through the supply passage.

20 Claims, 13 Drawing Sheets

CAMSHAFT PHASER

TECHNICAL FIELD OF INVENTION

The present invention relates to a camshaft phaser for varying the phase relationship between a crankshaft and a camshaft in an internal combustion engine; more particularly to such a camshaft phaser which is a vane-type camshaft phaser; even more particularly to a vane-type camshaft phaser which uses torque reversals of the camshaft to actuate the camshaft phaser; and still even more particularly to such a camshaft phaser which uses check valve members biased toward respective check valve seats by centrifugal force to facilitate use of the torque reversals for actuating the camshaft phaser.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers by a phasing oil control valve in order to rotate the rotor within the stator and thereby change the phase relationship between the camshaft and the crankshaft. One such camshaft phaser is described in U.S. Pat. No. 8,534,246 to Lichti et al., the disclosure of which is incorporated herein by reference in its entirety and hereinafter referred to as Lichti et al.

While the camshaft phaser of Lichti et al. may be effective, the camshaft phaser may be parasitic on the lubrication system of the internal combustion engine which also supplies the oil for rotating the rotor relative to the stator, thereby requiring increased capacity of an oil pump of the internal combustion engine which adds load to the internal combustion engine. In an effort to reduce the parasitic nature of camshaft phasers, so-called cam torque actuated camshaft phasers have also been developed. In a cam torque actuated camshaft phaser, oil is moved directly from the advance chambers to the retard chambers or directly from the retard chambers to the advance chambers based on torque reversals imparted on the camshaft from intake and exhaust valves of the internal combustion engine. The torque reversals are predictable and cyclical in nature and alternate from tending to urge the rotor in the advance direction to tending to urge the rotor in the retard direction. The effects of the torque reversals on oil flow are known to be controlled by a valve spool positioned by a solenoid actuator. Accordingly, in order to advance the camshaft phaser, the valve spool is positioned by the solenoid actuator to create a passage with a first check valve therein which allows torque reversals to transfer oil from the advance chambers to the retard chambers while preventing torque reversals from transferring oil from the retard chambers to the advance chambers. Conversely, in order to retard the camshaft phaser, the valve spool is positioned by the solenoid actuator to create a passage with a second check valve therein which allows torque reversals to transfer oil from the retard chambers to the advance chambers while preventing torque reversals from transferring oil from the advance chambers to the retard chambers. One such camshaft phaser is described in U.S. Pat. No. 7,000,580 to Smith et al. However, packaging of the first check valve and the second check valve within the camshaft phaser, particularly packaging check valve springs needed for biasing check valve members of the first check valve and the second check valve toward respective check valve seats, results in added complexity.

What is needed is camshaft phaser which minimizes or eliminates one or more the shortcomings as set forth above.

SUMMARY OF THE INVENTION

Briefly described, a camshaft phaser is provided for use with an internal combustion engine for controllably varying the phase relationship between a crankshaft and a camshaft in the internal combustion engine. The camshaft phaser includes a stator having a plurality of lobes and is connectable to the crankshaft of the internal combustion engine to provide a fixed ratio of rotation between the stator and the crankshaft about an axis; a rotor coaxially disposed within the stator, the rotor having a plurality of vanes interspersed with the lobes defining a plurality of alternating advance chambers and retard chambers; a camshaft phaser attachment bolt for attaching the camshaft phaser to the camshaft, the camshaft phaser attachment bolt defining a valve bore that is coaxial with the stator. A supply passage extends radially outward from the valve bore, the supply passage having a supply passage downstream end that is proximal to the valve bore and a supply passage upstream end that is distal from the valve bore, the supply passage downstream end and the supply passage upstream end being separated by a check valve seat. A check valve member in the supply passage prevents flow of oil past the check valve seat from the supply passage downstream end to the supply passage upstream end and allows flow of oil past the check valve seat from the supply passage upstream end to the supply passage downstream end, wherein the check valve member is biased toward the check valve seat by centrifugal force. A valve spool is moveable within the valve bore such that the valve spool directs oil that has passed through the supply passage to the valve bore.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
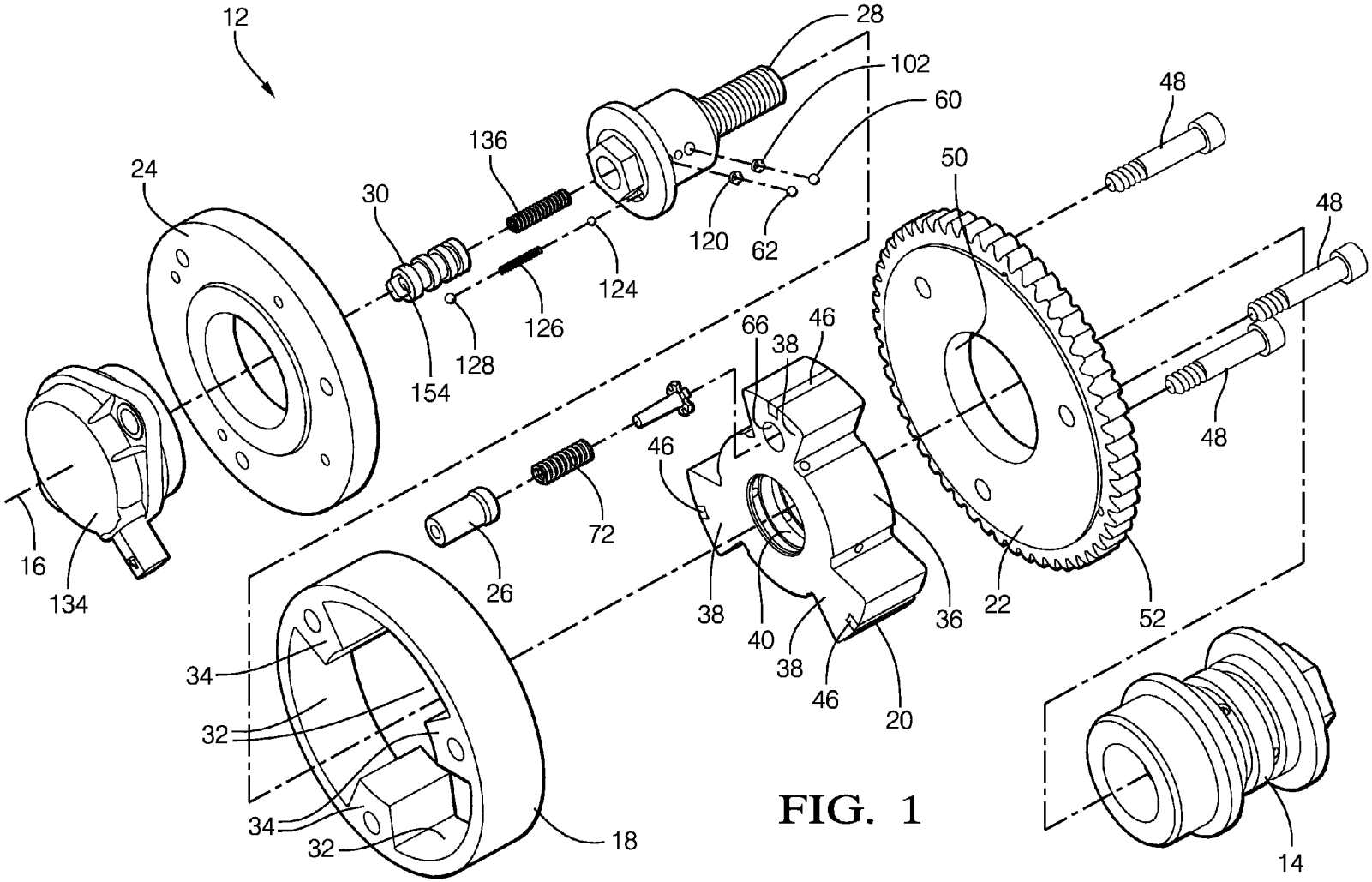
FIG. 1 is an exploded isometric view of a camshaft phaser in accordance with the present invention.

In accordance with a preferred embodiment of this invention and referring to FIGS. 1-4, an internal combustion engine 10 is shown which includes a camshaft phaser 12. Internal combustion engine 10 also includes a camshaft 14 which is rotatable about a camshaft axis 16 based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 18 which acts as an input member, a rotor 20 disposed coaxially within stator 18 which acts as an output member, a back cover 22 closing off one end of stator 18, a front cover 24 closing off the other end of stator 18, a lock pin 26, a camshaft phaser attachment bolt 28 for attaching camshaft phaser 12 to camshaft 14, and a valve spool 30. The various elements of camshaft phaser 12 will be described in greater detail in the paragraphs that follow. It should be noted that camshaft phaser attachment bolt 28 and valve spool 30 are sectioned in the same location for all of the axial cross-sectional views (FIGS. 3-9) regardless of the section location of stator 18 and rotor 22.

Stator 18 is generally cylindrical and includes a plurality of radial chambers 32 defined by a plurality of lobes 34 extending radially inward. In the embodiment shown, there are three lobes 34 defining three radial chambers 32, however, it is to be understood that a different number of lobes 34 may be provided to define radial chambers 32 equal in quantity to the number of lobes 34.

Rotor 20 includes a central hub 36 with a plurality of vanes 38 extending radially outward therefrom and a rotor central through bore 40 extending axially therethrough. The number of vanes 38 is equal to the number of radial chambers 32 provided in stator 18. Rotor 20 is coaxially disposed within stator 18 such that each vane 38 divides each radial chamber 32 into advance chambers 42 and retard chambers 44. The radial tips of lobes 34 are mateable with central hub 36 in order to separate radial chambers 32 from each other. Each of the radial tips of vanes 38 may include one of a plurality of wiper seals 46 to substantially seal adjacent advance chambers 42 and retard chambers 44 from each other. While not shown, each of the radial tips of lobes 34 may also include one of a plurality of wiper seals 46.

Back cover 22 is sealingly secured, using cover bolts 48, to the axial end of stator 18 that is proximal to camshaft 14. Tightening of cover bolts 48 prevents relative rotation between back cover 22 and stator 18. Back cover 22 includes a back cover central bore 50 extending coaxially therethrough. The end of camshaft 14 is received coaxially within back cover central bore 50 such that camshaft 14 is allowed to rotate relative to back cover 22. Stator 18 may also include a sprocket 52 formed integrally therewith or otherwise fixed thereto. Sprocket 52 is configured to be driven by a chain that is driven by the crankshaft of internal combustion engine 10. Alternatively, sprocket 52 may be a pulley driven by a belt or may be any other known drive member known for driving camshaft phaser 12 by the crankshaft.

Similarly, front cover 24 is sealingly secured, using cover bolts 48, to the axial end of stator 18 that is opposite back cover 22. Cover bolts 48 pass through back cover 22 and stator 18 and threadably engage front cover 24, thereby clamping stator 18 between back cover 22 and front cover 24 to prevent relative rotation between stator 18, back cover 22, and front cover 24. In this way, advance chambers 42 and retard chambers 44 are defined axially between back cover 22 and front cover 24.

Camshaft phaser 12 is attached to camshaft 14 with camshaft phaser attachment bolt 28 which extends coaxially through rotor central through bore 40 of rotor 20 and threadably engages camshaft 14, thereby by clamping rotor 20 securely to camshaft 14. In this way, relative rotation between stator 18 and rotor 20 results in a change in phase or timing between the crankshaft of internal combustion engine 10 and camshaft 14.

Oil is selectively transferred to advance chambers 42 from retard chambers 44, as a result of torque applied to camshaft 14 from the valve train of internal combustion engine 10, i.e. torque reversals of camshaft 14, in order to cause relative rotation between stator 18 and rotor 20 which results in retarding the timing of camshaft 14 relative to the crankshaft of internal combustion engine 10. Conversely, oil is selectively transferred to retard chambers 44 from advance chambers 42, as a result of torque applied to camshaft 14 from the valve train of internal combustion engine 10, in order to cause relative rotation between stator 18 and rotor 20 which results in advancing the timing of camshaft 14 relative to the crankshaft of internal combustion engine 10. Rotor advance passages 56 may be provided in rotor 20 for supplying and venting oil to and from advance chambers 42 while rotor retard passages 58 may be provided in rotor 20 for supplying and venting oil to and from retard chambers 44. Transferring oil to advance chambers 42 from retard chambers 44 and transferring oil to retard chambers 44 from advance chambers 42 is controlled by valve spool 30, an advance check valve member 60, and a retard check valve member 62, as will be described in detail later, such that valve spool 30 is coaxially disposed slidably within a valve bore 64 of camshaft phaser attachment bolt 28 where valve bore 64 is centered about camshaft axis 16.

Lock pin 26 selectively prevents relative rotation between stator 18 and rotor 20 at a predetermined aligned position of rotor 20 within stator 18, which as shown, may be a full advance position, i.e. rotor 20 is rotated as far as possible within stator 18 in the advance direction of rotation. Lock pin 26 is slidably disposed within a lock pin bore 66 formed in one vane 38 of rotor 20. A lock pin seat 68 is provided in front cover 24 for selectively receiving lock pin 26 therewithin. Lock pin 26 and lock pin seat 68 are sized to substantially prevent rotation between stator 18 and rotor 20 when lock pin 26 is received within lock pin seat 68. When lock pin 26 is not desired to be seated within lock pin seat 68, pressurized oil is supplied to lock pin bore 66 through a rotor lock pin passage 70 formed in rotor 20, thereby urging lock pin 26 out of lock pin seat 68 and compressing a lock pin spring 72. Conversely, when lock pin 26 is desired to be seated within lock pin seat 68, the pressurized oil is vented from lock pin bore 66 through rotor lock pin passage 70, thereby allowing lock pin spring 72 to urge lock pin 26 toward front cover 24. In this way, lock pin 26 is seated within lock pin seat 68 by lock pin spring 72 when rotor 20 is positioned within stator 18 to allow alignment of lock pin 26 with lock pin seat 68. Supplying and venting of pressurized oil to and from lock pin 26 is controlled by valve spool 30 as will be described later.

Camshaft phaser attachment bolt 28 and valve spool 30, which act together to function as a valve, will now be described in greater detail with continued reference to FIGS. 1-4 and now with additional reference to FIGS. 5A-9. Camshaft phaser attachment bolt 28 includes a bolt supply passage 74 which extends axially into camshaft phaser attachment bolt 28 such that bolt supply passage 74 is radially offset from valve bore 64, and as shown, bolt supply passage 74 may be substantially parallel to valve bore 64. One end of bolt supply passage 74 which is proximal to camshaft 14 receives pressurized oil from an oil source 76, for example an oil pump of internal combustion engine 10 which lubricates various elements of internal combustion engine 10, via an annular oil supply passage 78 formed radially between camshaft phaser attachment bolt 28 and a counter bore of camshaft 14 and also via a central bolt oil feed passage 80. The pressurized oil from oil source 76 is used to replenish oil that may leak from advance chambers 42 and retard chambers 44 in use and to disengage lock pin 26 from lock pin seat 68.

Camshaft phaser attachment bolt 28 also includes a bolt lock pin supply passage 82 which extends radially inward from bolt supply passage 74 to valve bore 64 and a bolt lock pin passage 84 which extends radially inward from the outer circumference of camshaft phaser attachment bolt 28 to valve bore 64 such that bolt lock pin supply passage 82 and bolt lock pin passage 84 are axially aligned, i.e. bolt lock pin supply passage 82 and bolt lock pin passage 84 are located at the same position along camshaft axis 16. It should be noted that bolt lock pin supply passage 82 diametrically opposes bolt lock pin passage 84 in order to facilitate formation of bolt lock pin supply passage 82. Bolt lock pin passage 84 is axially aligned with a rotor annular lock pin groove 86 which extends radially outward from rotor central through bore 40 such that rotor lock pin passage 70 extends from rotor annular lock pin groove 86 to lock pin bore 66. In this way, fluid communication is provided between valve bore 64 and lock pin bore 66.

Camshaft phaser attachment bolt 28 also includes a bolt advance supply passage 88 which extends radially inward from bolt supply passage 74 to valve bore 64 and a bolt advance passage 90 which extends radially inward from the outer circumference of camshaft phaser attachment bolt 28 to valve bore 64 such that bolt advance supply passage 88 and bolt advance passage 90 are axially aligned, i.e. bolt advance supply passage 88 and bolt advance passage 90 are located at the same position along camshaft axis 16. Bolt advance supply passage 88 and bolt advance passage 90 are axially spaced from bolt lock pin supply passage 82 and bolt lock pin passage 84 in a direction away from camshaft 14. Bolt advance passage 90 is axially aligned with a rotor annular advance groove 92 which extends radially outward from rotor central through bore 40 such that rotor advance passages 56 extend from rotor annular advance groove 92 to advance chambers 42. In this way, fluid communication is provided between valve bore 64 and advance chambers 42.

Bolt advance supply passage 88 includes a bolt advance supply passage downstream end 94 (labeled only in FIG. 9) which is proximal to valve bore 64 and a bolt advance supply passage upstream end 96 (labeled only in FIG. 9) which is distal from valve bore 64 such that bolt advance supply passage downstream end 94 and bolt advance supply passage upstream end 96 are separated by an advance check valve seat 98. Advance check valve member 60 is located within bolt advance supply passage 88 such that advance check valve member 60 is biased toward advance check valve seat 98 by centrifugal force caused by rotation of camshaft phaser 12 about camshaft axis 16 in use. Advance check valve member 60, illustrated as a ball, prevents oil flow past advance check valve seat 98 from bolt advance supply passage downstream end 94 to bolt advance supply passage upstream end 96 while allowing oil flow past advance check valve seat 98 from bolt advance supply passage upstream end 96 to bolt advance supply passage downstream end 94 as will be described in greater detail later. As illustrated herein, advance check valve seat 98 is defined by an advance check valve cage 102 which captures advance check valve member 60 therein, thereby preventing advance check valve member 60 from exiting bolt advance supply passage 88. Advance check valve cage 102 (labeled only in FIG. 9) may be press fit within bolt advance supply passage 88 such that oil is substantially prevented from passing between the interface of advance check valve cage 102 and bolt advance supply passage 88. In an alternative arrangement, advance check valve seat 98 may be formed directly in the geometry of bolt advance supply passage 88, for example, by providing a frustoconical region in bolt advance supply passage 88. When advance check valve seat 98 is formed directly in the geometry of bolt advance supply passage 88, advance check valve cage 102 may be omitted and advance check valve member 60 may be retained within bolt advance supply passage 88 by a separate retainer. Alternatively, when advance check valve seat 98 is formed directly in the geometry of bolt advance supply passage 88, advance check valve member 60 may be retained within bolt advance supply passage 88 by valve spool 30. When camshaft 14 is rotationally stationary, advance check valve member 60 may be partly received within a groove (to be described later) in valve spool 30, however, the groove is sufficiently shallow to prevent advance check valve member 60 from coming entirely out of bolt advance supply passage 88 or from jamming valve spool 30. Furthermore, valve spool 30 is typically not required to move within valve bore 64 when camshaft 14 is rotationally stationary, and when valve spool 30 is required to move within valve bore 64, camshaft 14 will be rotating such that advance check valve member 60 will be positioned against advance check valve seat 98 by centrifugal force. It should be noted that bolt advance supply passage 88 diametrically opposes bolt advance passage 90 in order to facilitate formation of bolt advance supply passage 88 and insertion of advance check valve member 60 and advance check valve cage 102 in bolt advance supply passage 88 through bolt advance passage 90.

Camshaft phaser attachment bolt 28 also includes a bolt recirculation passage 104 which extends radially inward from bolt supply passage 74 to valve bore 64. Bolt recirculation passage 104 is axially spaced from bolt advance supply passage 88 and bolt advance passage 90 in a direction away from camshaft 14.

Camshaft phaser attachment bolt 28 also includes a bolt retard supply passage 106 which extends radially inward from bolt supply passage 74 to valve bore 64 and a bolt retard passage 108 which extends radially inward from the outer circumference of camshaft phaser attachment bolt 28 to valve bore 64 such that bolt retard supply passage 106 and bolt retard passage 108 are axially aligned, i.e. bolt retard supply passage 106 and bolt retard passage 108 are located at the same position along camshaft axis 16. Bolt retard supply passage 106 and bolt retard passage 108 are axially spaced from bolt recirculation passage 104 in a direction away from camshaft 14. Bolt retard passage 108 is axially aligned with a rotor annular retard groove 110 which extends radially outward from rotor central through bore 40 such that rotor retard passages 58 extend from rotor annular retard groove 110 to retard chambers 44. In this way, fluid communication is provided between valve bore 64 and retard chambers 44.

Bolt retard supply passage 106 includes a bolt retard supply passage downstream end 112 (labeled only in FIG. 9) which is proximal to valve bore 64 and a bolt retard supply passage upstream end 114 (labeled only in FIG. 9) which is distal from valve bore 64 such that bolt retard supply passage downstream end 112 and bolt retard supply passage upstream end 114 are separated by a retard check valve seat 116. Retard check valve member 62 is located within bolt retard supply passage 106 such that retard check valve member 62 is biased toward retard check valve seat 116 by centrifugal force caused by rotation of camshaft phaser 12 about camshaft axis 16 in use. Retard check valve member 62, illustrated as a ball, prevents oil flow past retard check valve seat 116 from bolt retard supply passage downstream end 112 to bolt retard supply passage upstream end 114 while allowing oil flow past retard check valve seat 116 from bolt retard supply passage upstream end 114 to bolt retard supply passage downstream end 112 as will be described in greater detail later. As illustrated herein, retard check valve seat 116 is defined by a retard check valve cage 120 (labeled only in FIG. 9) which captures retard check valve member 62 therein, thereby preventing retard check valve member 62 from exiting bolt retard supply passage 106. Retard check valve cage 120 may be press fit within bolt retard supply passage 106 such that oil is substantially prevented from passing between the interfaced of retard check valve cage 120 and bolt retard supply passage 106. In an alternative arrangement, retard check valve seat 116 may be formed directly in the geometry of bolt retard supply passage 106, for example, by providing a frustoconical region in bolt retard supply passage 106. When retard check valve seat 116 is formed directly in the geometry of bolt retard supply passage 106, retard check valve cage 120 may be omitted and retard check valve member 62 may be retained within bolt retard supply passage 106 by a separate retainer. Alternatively, when retard check valve seat 116 is formed directly in the geometry of bolt retard supply passage 106, retard check valve member 62 may be retained within bolt retard supply passage 106 by valve spool 30. When camshaft 14 is rotationally stationary, retard check valve member 62 may be partly received within a groove (to be described later) in valve spool 30, however, the groove is sufficiently shallow to prevent retard check valve member 62 from coming entirely out of bolt retard supply passage 106 or from jamming valve spool 30. Furthermore, valve spool 30 is typically not required to move within valve bore 64 when camshaft 14 is rotationally stationary, and when valve spool 30 is required to move within valve bore 64, camshaft 14 will be rotating such that retard check valve member 62 will be positioned against retard check valve seat 116 by centrifugal force. It should be noted that bolt retard supply passage 106 diametrically opposes bolt retard passage 108 in order to facilitate formation of bolt retard supply passage 106 and insertion of retard check valve member 62 and retard check valve cage 120 in bolt retard supply passage 106 through bolt retard passage 108.

A supply check valve seat 122 is located within bolt supply passage 74 between bolt lock pin supply passage 82 and bolt advance supply passage 88. A supply check valve member 124, illustrated as a ball, is located within bolt supply passage 74 and biased toward supply check valve seat 122 by a supply check valve spring 126 which is grounded to camshaft phaser attachment bolt 28, for example by a bolt supply passage plug 128 which is sealing disposed in the end of bolt supply passage 74 that is distal from camshaft 14. Bolt supply passage plug 128 is installed within bolt supply passage 74 after supply check valve member 124 and supply check valve spring 126 have been installed within bolt supply passage 74. Supply check valve seat 122 divides bolt supply passage 74 into a bolt supply passage lock pin portion 130 which is in constant fluid communication with bolt lock pin supply passage 82 and a bolt supply passage phasing portion 132 which is in constant fluid communication with bolt advance supply passage 88, bolt recirculation passage 104, and bolt retard supply passage 106. Consequently supply check valve member 124 seats with supply check valve seat 122 to prevent fluid communication from bolt supply passage lock pin portion 130 to bolt supply passage phasing portion 132 when the pressure within bolt supply passage phasing portion 132 is greater than the pressure within bolt supply passage lock pin portion 130. Also consequently, supply check valve member 124 unseats from supply check valve seat 122 to permit fluid communication from bolt supply passage lock pin portion 130 to bolt supply passage phasing portion 132 when the pressure within bolt supply passage phasing portion 132 is less than the pressure within bolt supply passage lock pin portion 130.

Valve spool 30 is moved axially within valve bore 64 of camshaft phaser attachment bolt 28 by an actuator 134 and a valve spring 136 to achieve desired operational states of camshaft phaser 12 by controlling flow and pressure through bolt lock pin supply passage 82, bolt lock pin passage 84, bolt advance supply passage 88, bolt advance passage 90, bolt recirculation passage 104, bolt retard supply passage 106, and bolt retard passage 108 as will be described in the subsequent paragraphs. Valve spool 30 includes a valve spool bore 138 extending axially thereinto from the end of valve spool 30 that is proximal to camshaft 14. Valve spring 136 is received within valve spool bore 138 such that valve spring 136 is captured between the bottom of valve spool bore 138 and the bottom of valve bore 64 of camshaft phaser attachment bolt 28.

Valve spool 30 also includes a lock pin land 140 which is sized to fit within valve bore 64 in a close sliding relationship such that oil is substantially prevented from passing between the interface between lock pin land 140 and valve bore 64 while allowing valve spool 30 to be displaced axially within valve bore 64 substantially uninhibited. Lock pin land 140 is located at the end of valve spool 30 that is proximal to the bottom of valve bore 64 of camshaft phaser attachment bolt 28.

Valve spool 30 also includes an advance land 142 which is axially spaced from lock pin land 140, thereby defining a spool annular lock pin groove 144 axially between lock pin land 140 and advance land 142. Advance land 142 is sized to fit within valve bore 64 in a close sliding relationship such that oil is substantially prevented from passing between the interface between advance land 142 and valve bore 64 while allowing valve spool 30 to be displaced axially within valve bore 64 substantially uninhibited.

Valve spool 30 also includes a recirculation land 146 which is axially spaced from advance land 142, thereby defining a spool annular advance groove 148 axially between advance land 142 and recirculation land 146. Recirculation land 146 is sized to fit within valve bore 64 in a close sliding relationship such that oil is substantially prevented from passing between the interface between recirculation land 146 and valve bore 64 while allowing valve spool 30 to be displaced axially within valve bore 64 substantially uninhibited.

Valve spool 30 also includes a retard land 150 which is axially spaced from recirculation land 146, thereby defining a spool annular retard groove 152 axially between recirculation land 146 and retard land 150. Retard land 150 is sized to fit within valve bore 64 in a close sliding relationship such that oil is substantially prevented from passing between the interface between retard land 150 and valve bore 64 while allowing valve spool 30 to be displaced axially within valve bore 64 substantially uninhibited.

Valve spool 30 also includes a pair of opposing vent apertures 154 which extend radially outward through valve spool 30 from valve spool bore 138 such that vent apertures 154 are located to the axial side of retard land 150 that is opposite spool annular retard groove 152. Vent apertures 154 provide fluid communication between valve spool bore 138 and the end of valve bore 64 of camshaft phaser attachment bolt 28 that is distal from camshaft 14, thereby allowing oil in valve spool bore 138 to be vented out of camshaft phaser 12 and back to oil source 76.

Figure 5A:
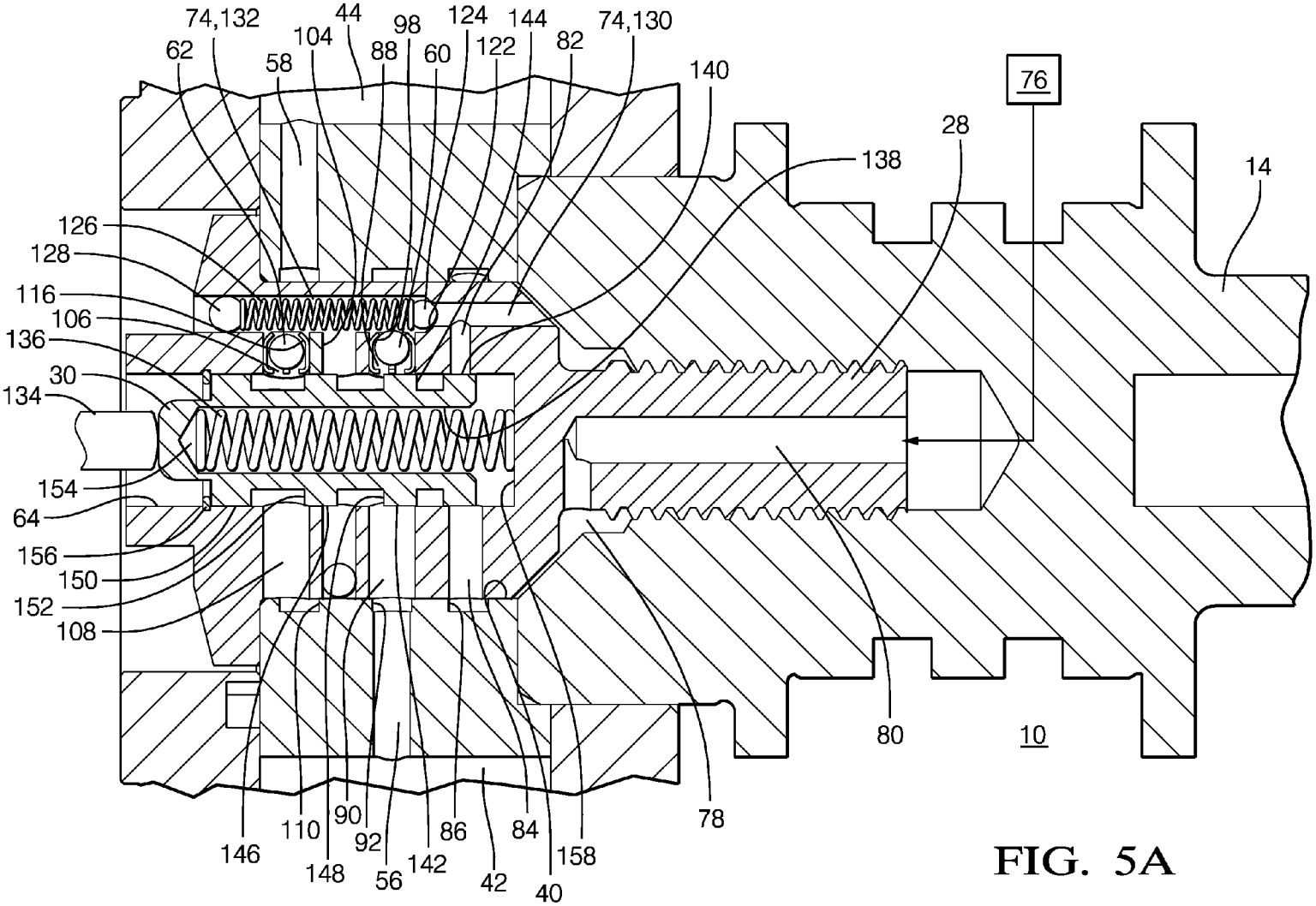
FIG. 5A is an enlarged portion of FIG. 4 showing a valve spool of the camshaft phaser in a default position.
Figure 5B:
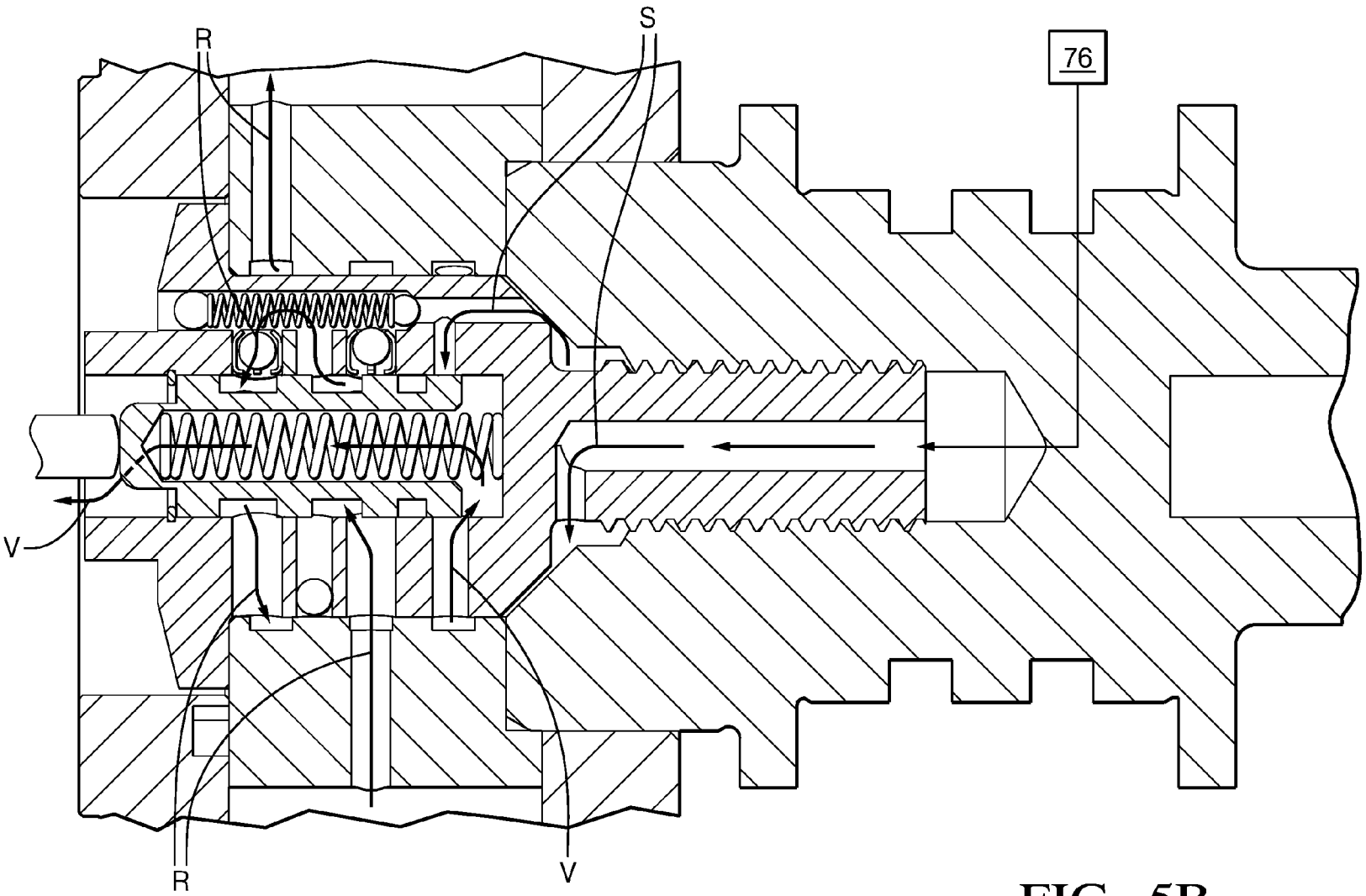
FIG. 5B is the view of FIG. 5A shown with reference numbers removed in order to clearly shown the path of travel of oil.

Actuator 134 may be a solenoid actuator that is selectively energized with an electric current of varying magnitude in order to position valve spool 30 within valve bore 64 at desired axial positions, thereby controlling oil flow to achieve desired operation of camshaft phaser 12. In a default position, when no electric current is supplied to actuator 134 as shown in FIGS. 5A and 5B, valve spring 136 urges valve spool 30 in a direction toward actuator 134 until valve spool 30 axially abuts a first stop member 156, which may be, by way of non-limiting example only, a snap ring within a snap ring groove extending radially outward from valve bore 64. In the default position, lock pin land 140 is positioned to block bolt lock pin supply passage 82, thereby preventing pressurized oil from being supplied to lock pin 26 and lock pin bore 66 from oil source 76. Also in the default position, lock pin land 140 is positioned to permit fluid communication between bolt lock pin passage 84 and valve spool bore 138 via valve bore 64, thereby allowing oil to be vented from lock pin 26 and lock pin bore 66 via rotor lock pin passage 70, rotor annular lock pin groove 86, bolt lock pin passage 84, valve bore 64, valve spool bore 138, and vent apertures 154 and consequently allowing lock pin spring 72 to urge lock pin 26 toward front cover 24. Also in the default position, advance land 142 and recirculation land 146 are positioned to permit fluid communication from bolt advance passage 90 to bolt recirculation passage 104 through spool annular advance groove 148. Also in the default position, recirculation land 146 is positioned to prevent fluid communication from bolt retard passage 108 to bolt recirculation passage 104 through spool annular advance groove 148 while permitting fluid communication from bolt recirculation passage 104 to bolt retard passage 108 via bolt supply passage 74, bolt retard supply passage 106, and spool annular retard groove 152. In this way, torque reversals of camshaft 14 that tend to pressurize oil within advance chambers 42 cause oil to be vented out of advance chambers 42 and to be supplied to retard chambers 44 via rotor advance passages 56, rotor annular advance groove 92, bolt advance passage 90, spool annular advance groove 148, bolt recirculation passage 104, bolt supply passage 74, bolt retard supply passage 106, spool annular retard groove 152, bolt retard passage 108, rotor annular retard groove 110, and rotor retard passages 58. It should be noted that torque reversals of camshaft 14 that tend to pressurize oil within advance chambers 42 cause retard check valve member 62 to be unseated from retard check valve seat 116, thereby allowing oil to flow from bolt supply passage 74 to spool annular retard groove 152 through bolt retard supply passage 106. However, torque reversals of camshaft 14 that tend to pressurize oil within retard chambers 44 are prevented from venting oil from retard chambers 44 because retard check valve member 62 prevents oil from being supplied to advance chambers 42. Consequently, in the default position, torque reversals of camshaft 14 cause rotor 20 to rotate relative to stator 18 to cause an advance in timing of camshaft 14 relative to the crankshaft, and when lock pin 26 is aligned with lock pin seat 68, lock pin spring 72 urges lock pin 26 into lock pin seat 68 to retain rotor 20 in the predetermined aligned position with stator 18. In FIG. 5B, the reference numbers have been removed for clarity and arrows representing the path of travel of the oil have been included where arrows S represent oil from oil source 76, arrows V represent vented oil from lock pin bore 66, and arrows R represent oil that is being recirculated for rotating rotor 20 relative to stator 18. It should be noted that FIG. 5B shows retard check valve member 62 being unseated from retard check valve seat 116, but retard check valve member 62 may also be seated with retard check valve seat 116 depending on the direction of the torque reversal of camshaft 14 at a particular time.

Figure 6A:
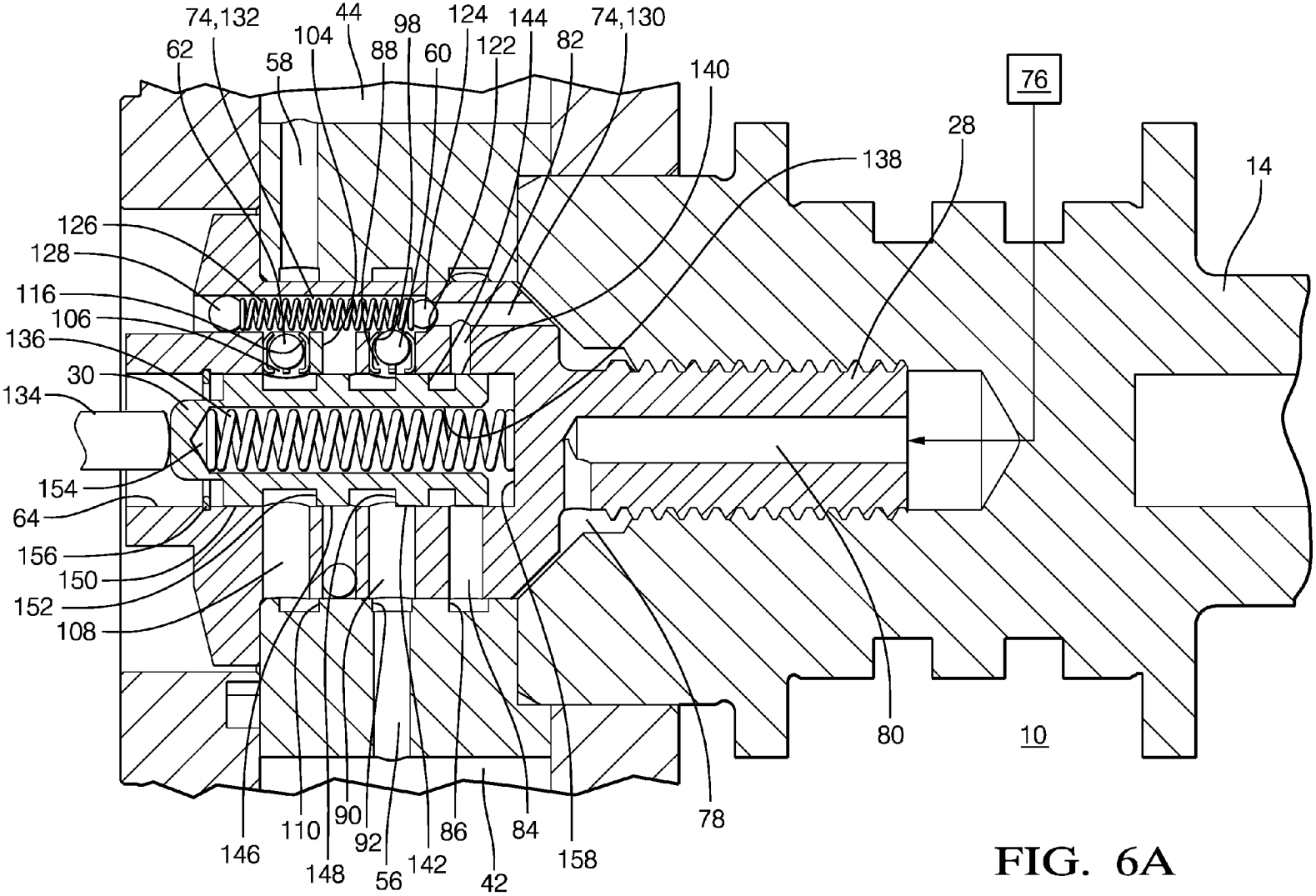
FIG. 6A is the view of FIG. 5A now shown with the valve spool in an advance position.
Figure 6B:
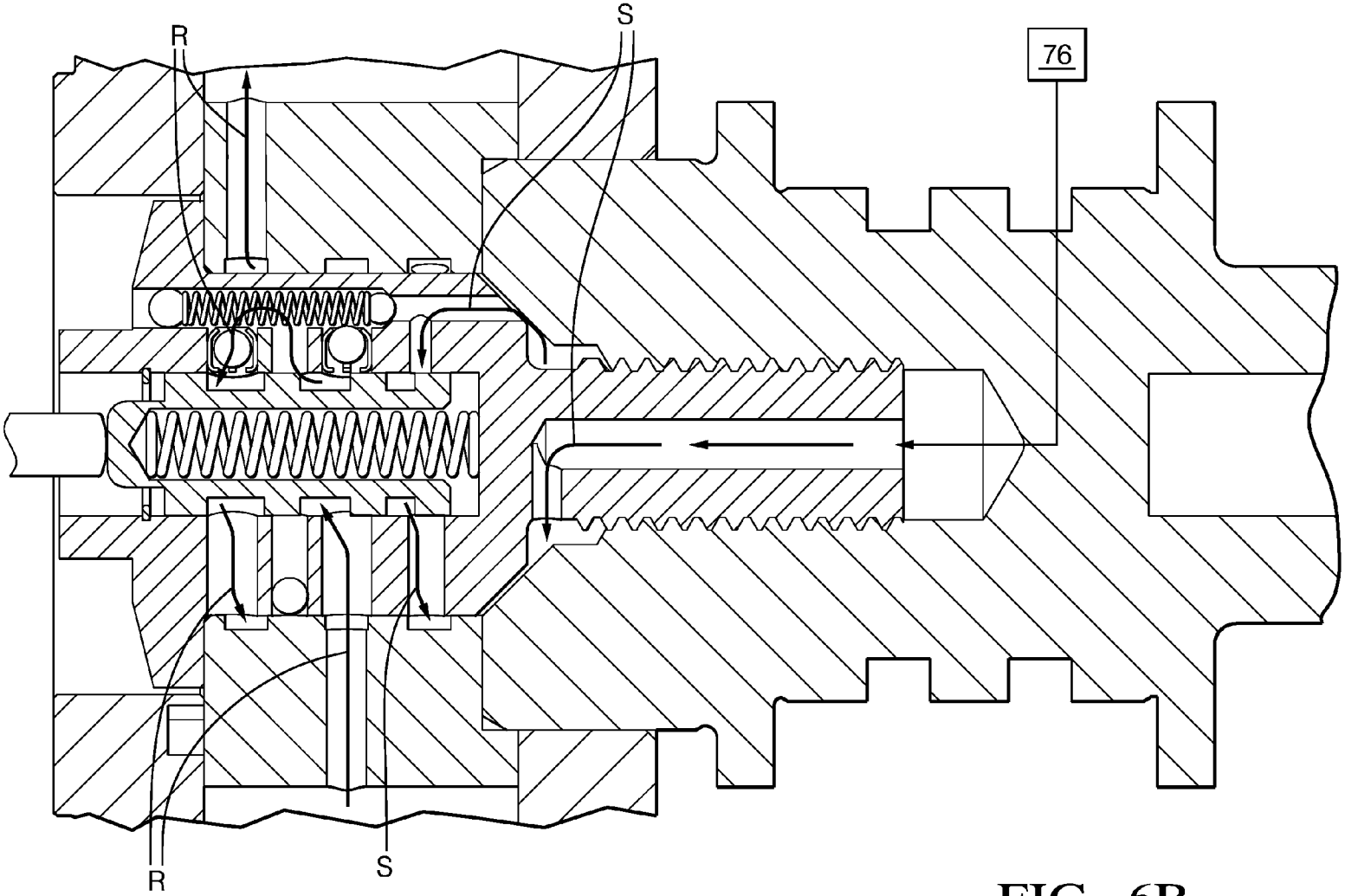
FIG. 6B is the view of FIG. 6A shown with reference numbers removed and arrows added in order to clearly shown the path of travel of oil.

In an advance position, when an electric current of a first magnitude is supplied to actuator 134 as shown in FIGS. 6A and 6B, actuator 134 urges valve spool 30 in a direction toward valve spring 136 thereby causing valve spring 136 to be compressed slightly. In the advance position, lock pin land 140 is positioned to block fluid communication between bolt lock pin passage 84 and valve spool bore 138 and also to block fluid communication between bolt lock pin supply passage 82 and valve spool bore 138, thereby preventing oil from being vented from lock pin 26 and lock pin bore 66. Also in the advance position, lock pin land 140 is positioned to permit fluid communication between bolt lock pin supply passage 82 and bolt lock pin passage 84 through spool annular lock pin groove 144, thereby allowing pressurized oil to be supplied to lock pin 26 and lock pin bore 66 from oil source 76 via bolt supply passage 74, bolt lock pin supply passage 82, spool annular lock pin groove 144, bolt lock pin passage 84, rotor annular lock pin groove 86, and rotor lock pin passage 70, and consequently compressing lock pin spring 72 by urging lock pin 26 out of lock pin seat 68. Also in the advance position, advance land 142 and recirculation land 146 are positioned to permit fluid communication from bolt advance passage 90 to bolt recirculation passage 104 through spool annular advance groove 148. Also in the advance position, recirculation land 146 is positioned to prevent fluid communication from bolt retard passage 108 to bolt recirculation passage 104 through spool annular advance groove 148 while permitting fluid communication from bolt recirculation passage 104 to bolt retard passage 108 via bolt supply passage 74, bolt retard supply passage 106, and spool annular retard groove 152. In this way, torque reversals of camshaft 14 that tend to pressurize oil within advance chambers 42 cause oil to be vented out of advance chambers 42 and to be supplied to retard chambers 44 via rotor advance passages 56, rotor annular advance groove 92, bolt advance passage 90, spool annular advance groove 148, bolt recirculation passage 104, bolt supply passage 74, bolt retard supply passage 106, spool annular retard groove 152, bolt retard passage 108, rotor annular retard groove 110, and rotor retard passages 58. It should be noted that torque reversals of camshaft 14 that tend to pressurize oil within advance chambers 42 cause retard check valve member 62 to be unseated from retard check valve seat 116, thereby allowing oil to flow from bolt supply passage 74 to spool annular retard groove 152 through bolt retard supply passage 106. However, torque reversals of camshaft 14 that tend to pressurize oil within retard chambers 44 are prevented from venting oil from retard chambers 44 because retard check valve member 62 prevents oil from being supplied to advance chambers 42. Consequently, in the advance position, torque reversals of camshaft 14 cause rotor 20 to rotate relative to stator 18 to cause an advance in timing of camshaft 14 relative to the crankshaft. In FIG. 6B, the reference numbers have been removed for clarity and arrows representing the path of travel of the oil have been included where arrows S represent oil from oil source 76 and arrows R represent oil that is being recirculated for rotating rotor 20 relative to stator 18. It should be noted that FIG. 6B shows retard check valve member 62 being unseated from retard check valve seat 116, but retard check valve member 62 may also be seated with retard check valve seat 116 depending on the direction of the torque reversal of camshaft 14 at a particular time.

Figure 7A:
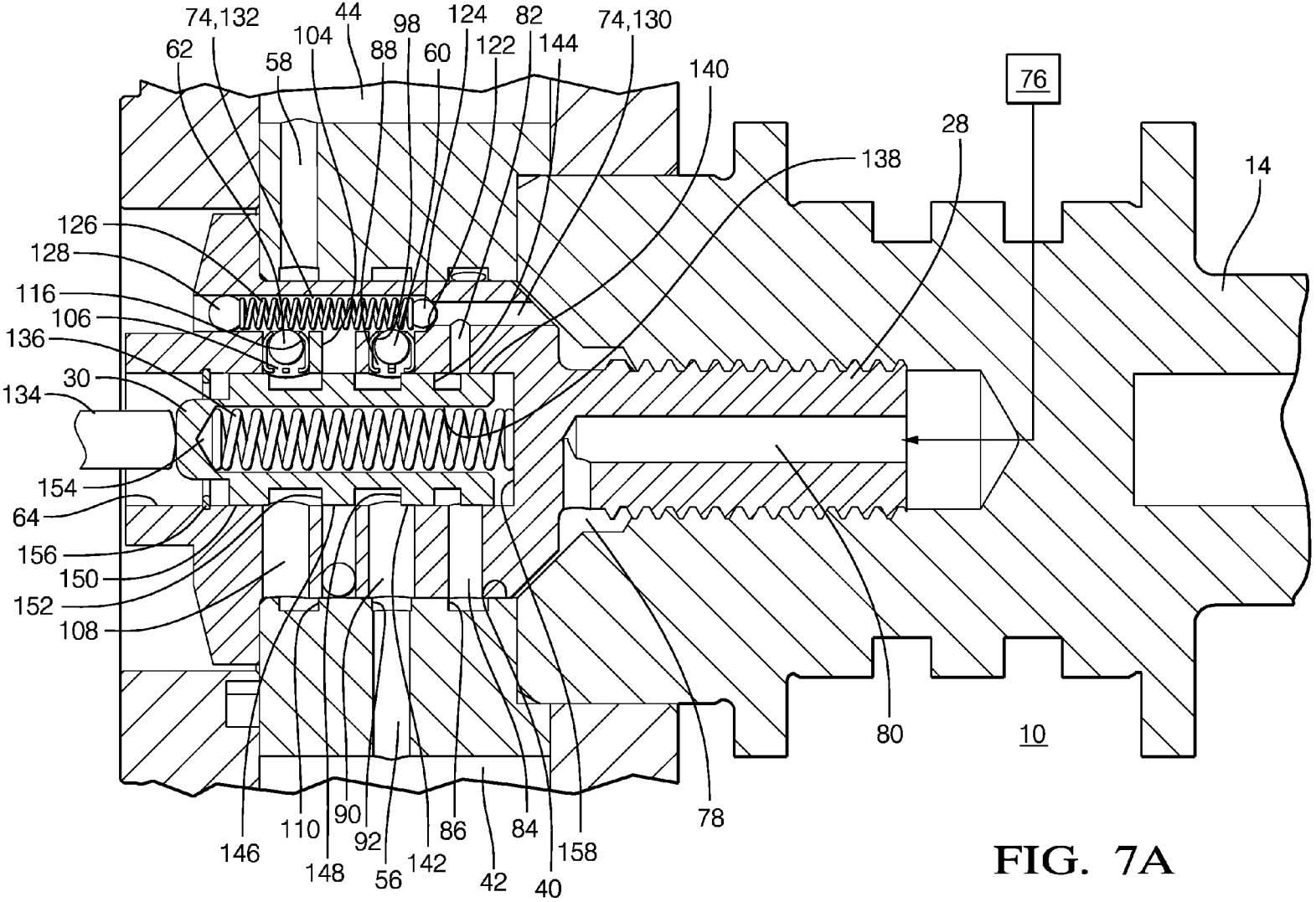
FIG. 7A is the view of FIG. 5A now shown with the valve spool in a hold position.
Figure 7B:
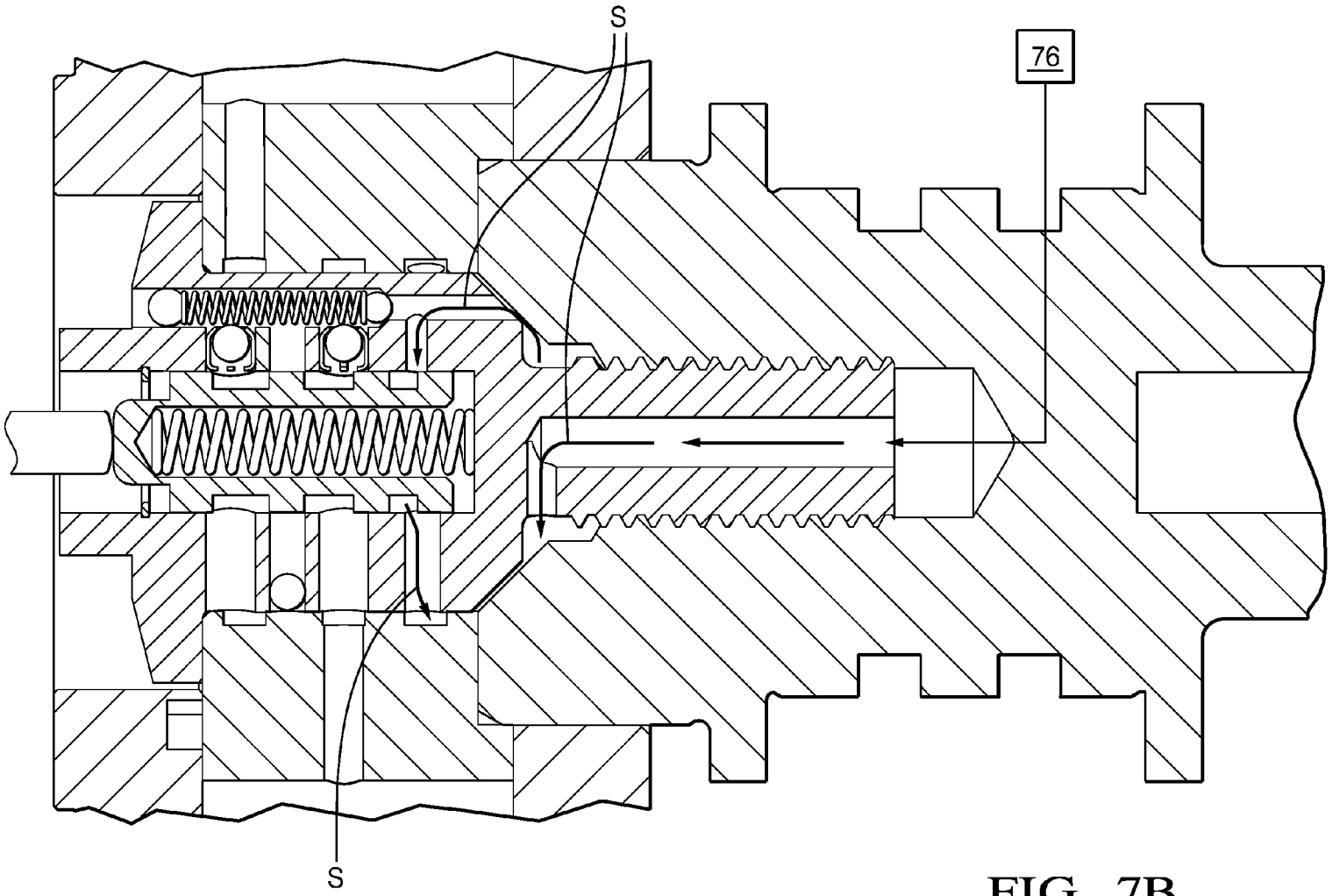
FIG. 7B is the view of FIG. 7A shown with reference numbers removed and arrows added in order to clearly shown the path of travel of oil.

In a hold position, when an electric current of a second magnitude is supplied to actuator 134 as shown in FIGS. 7A and 7B, actuator 134 urges valve spool 30 in a direction toward valve spring 136 thereby causing valve spring 136 to be compressed slightly more than in the advance position. In the hold position, lock pin land 140 is positioned to block fluid communication between bolt lock pin passage 84 and valve spool bore 138 and also to block fluid communication between bolt lock pin supply passage 82 and valve spool bore 138, thereby preventing oil from being vented from lock pin 26 and lock pin bore 66. Also in the hold position, lock pin land 140 is positioned to permit fluid communication between bolt lock pin supply passage 82 and bolt lock pin passage 84 through spool annular lock pin groove 144, thereby allowing pressurized oil to be supplied to lock pin 26 and lock pin bore 66 from oil source 76 via bolt supply passage 74, bolt lock pin supply passage 82, spool annular lock pin groove 144, bolt lock pin passage 84, rotor annular lock pin groove 86, and rotor lock pin passage 70, and consequently compressing lock pin spring 72 by urging lock pin 26 out of lock pin seat 68. Also in the hold position, advance land 142 and recirculation land 146 are positioned to allow fluid communication from bolt supply passage 74 to spool annular advance groove 148 through bolt advance supply passage 88. Also in the hold position, recirculation land 146 is positioned to block bolt recirculation passage 104, thereby preventing direct fluid communication between bolt recirculation passage 104 and spool annular advance groove 148 and also preventing direct fluid communication between bolt recirculation passage 104 and spool annular retard groove 152. Also in the hold position, retard land 150 and recirculation land 146 are positioned to allow fluid communication from bolt supply passage 74 to spool annular retard groove 152 through bolt retard supply passage 106. Since advance check valve member 60 prevents oil flow from spool annular advance groove 148 to bolt supply passage 74 and retard check valve member 62 prevents oil flow from spool annular retard groove 152 to bolt supply passage 74, oil is trapped within advance chambers 42 and retard chambers 44, thereby hydraulically locking rotor 20 and substantially maintaining the rotational position of rotor 20 relative to stator 18. In FIG. 7B, the reference numbers have been removed for clarity and arrows representing the path of travel of the oil have been included where arrows S represent oil from oil source 76.

Figure 8A:
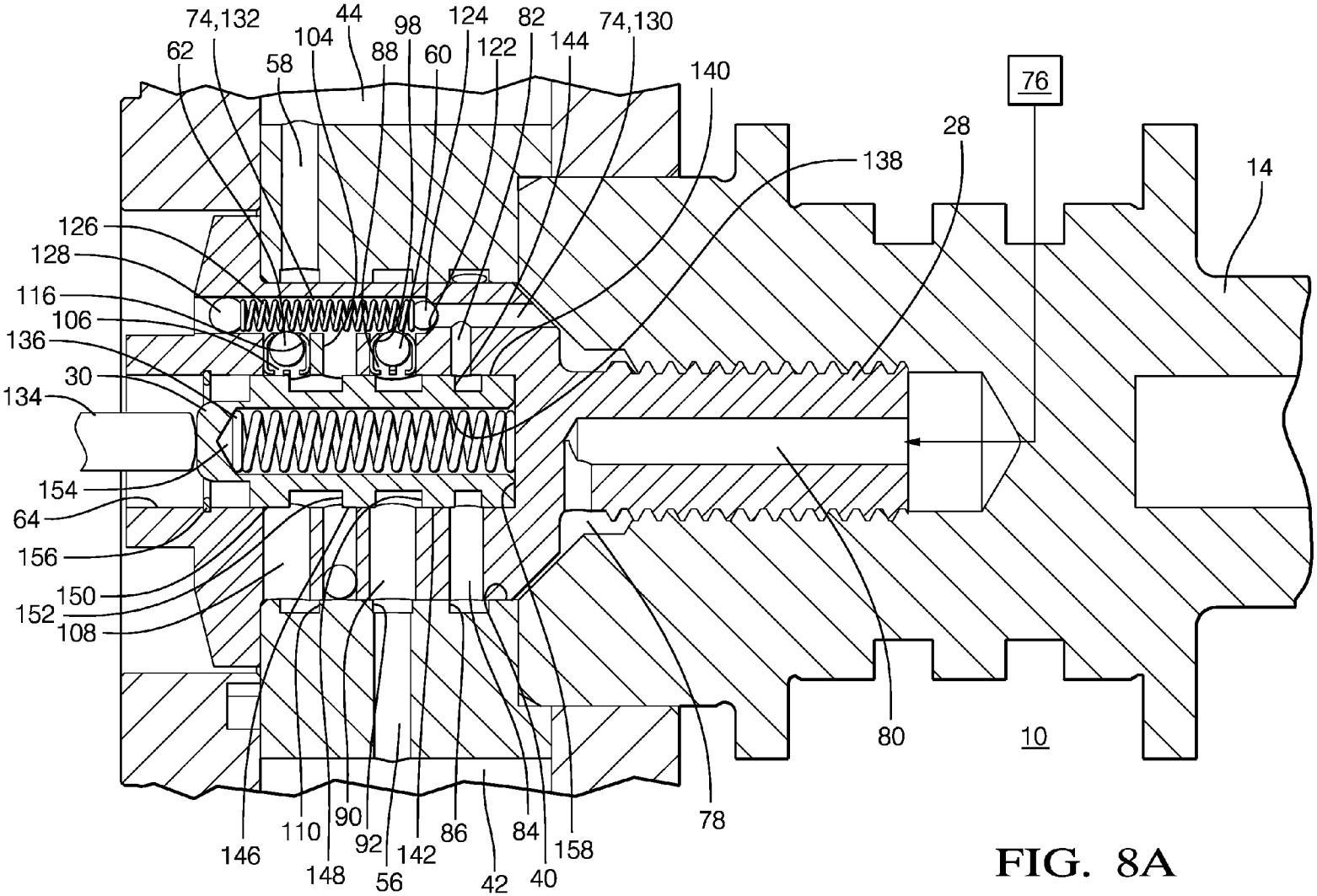
FIG. 8A is the view of FIG. 5A now shown with the valve spool in an retard position.
Figure 8B:
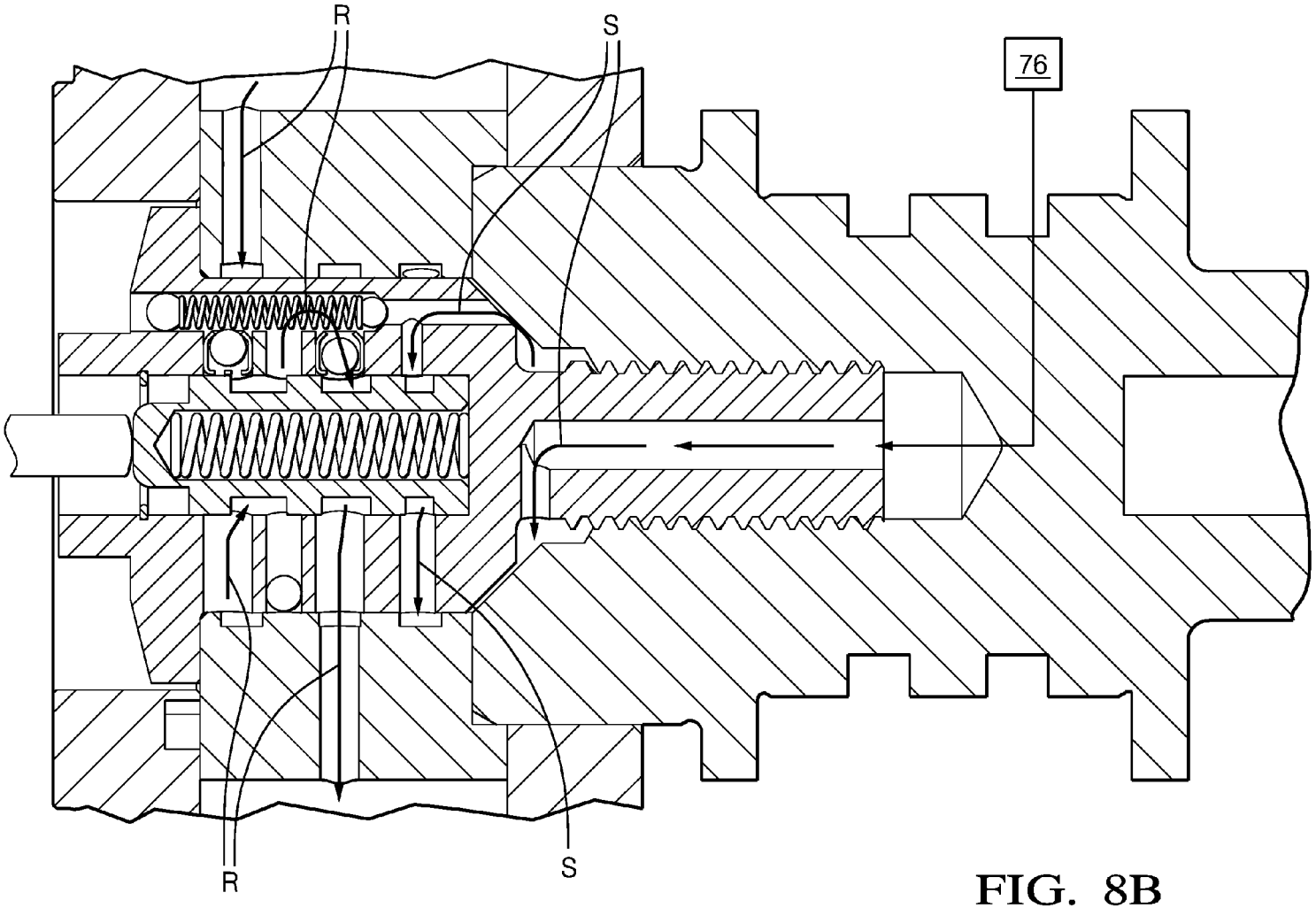
FIG. 8B is the view of FIG. 8A shown with reference numbers removed and arrows added in order to clearly shown the path of travel of oil.
Figure 9:
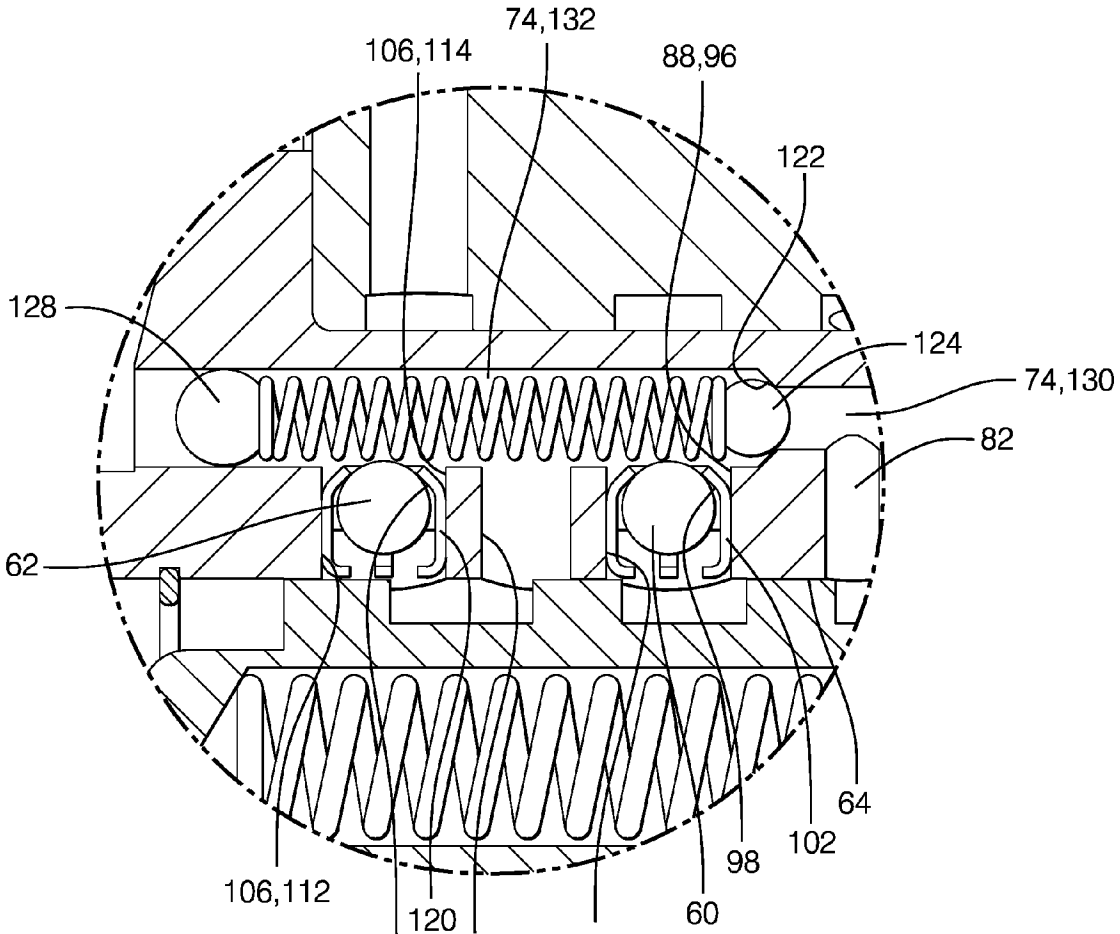
FIG. 9 is an enlarge portion of FIG. 5A.

In a retard position, when an electric current of a third magnitude is supplied to actuator 134 as shown in FIGS. 8A and 8B, actuator 134 urges valve spool 30 in a direction toward valve spring 136 thereby causing valve spring 136 to be compressed until valve spool 30 axially abuts a second stop member 158 which may be the bottom of valve bore 64 as shown. In the retard position, lock pin land 140 is positioned to block fluid communication between bolt lock pin passage 84 and valve spool bore 138 and also to block fluid communication between bolt lock pin supply passage 82 and valve spool bore 138, thereby preventing oil from being vented from lock pin 26 and lock pin bore 66. Also in the retard position, lock pin land 140 is positioned to permit fluid communication between bolt lock pin supply passage 82 and bolt lock pin passage 84 through spool annular lock pin groove 144, thereby allowing pressurized oil to be supplied to lock pin 26 and lock pin bore 66 from oil source 76 via bolt supply passage 74, bolt lock pin supply passage 82, spool annular lock pin groove 144, bolt lock pin passage 84, rotor annular lock pin groove 86, and rotor lock pin passage 70, and consequently compressing lock pin spring 72 by urging lock pin 26 out of lock pin seat 68. Also in the retard position, recirculation land 146 is positioned to prevent fluid communication from bolt advance passage 90 to bolt recirculation passage 104 through spool annular advance groove 148 while permitting fluid communication from bolt recirculation passage 104 to bolt advance passage 90 via bolt supply passage 74, bolt advance supply passage 88, and spool annular advance groove 148. Also in the retard position, retard land 150 and recirculation land 146 are positioned to permit fluid communication from bolt retard passage 108 to bolt recirculation passage 104 through spool annular retard groove 152. In this way, torque reversals of camshaft 14 that tend to pressurize oil within retard chambers 44 cause oil to be vented out of retard chambers 44 and to be supplied to advance chambers 42 via rotor retard passages 58, rotor annular retard groove 110, bolt retard passage 108, spool annular retard groove 152, bolt recirculation passage 104, bolt supply passage 74, bolt advance supply passage 88, spool annular advance groove 148, bolt advance passage 90, rotor annular advance groove 92, and rotor advance passages 56. It should be noted that torque reversals of camshaft 14 that tend to pressurize oil within retard chambers 44 cause advance check valve member 60 to be unseated from advance check valve seat 98, thereby allowing oil to flow from bolt supply passage 74 to spool annular advance groove 148 through bolt advance supply passage 88. However, torque reversals of camshaft 14 that tend to pressurize oil within advance chambers 42 are prevented from venting oil from advance chambers 42 because advance check valve member 60 prevents oil from being supplied to retard chambers 44. Consequently, in the retard position, torque reversals of camshaft 14 cause rotor 20 to rotate relative to stator 18 to cause a retard in timing of camshaft 14 relative to the crankshaft. In FIG. 8B, the reference numbers have been removed for clarity and arrows representing the path of travel of the oil have been included where arrows S represent oil from oil source 76 and arrows R represent oil that is being recirculated for rotating rotor 20 relative to stator 18. It should be noted that FIG. 8B shows advance check valve member 60 being unseated from advance check valve seat 98, but advance check valve member 60 may also be seated with advance check valve seat 98 depending on the direction of the torque reversal of camshaft 14 at a particular time.

Figure 2:
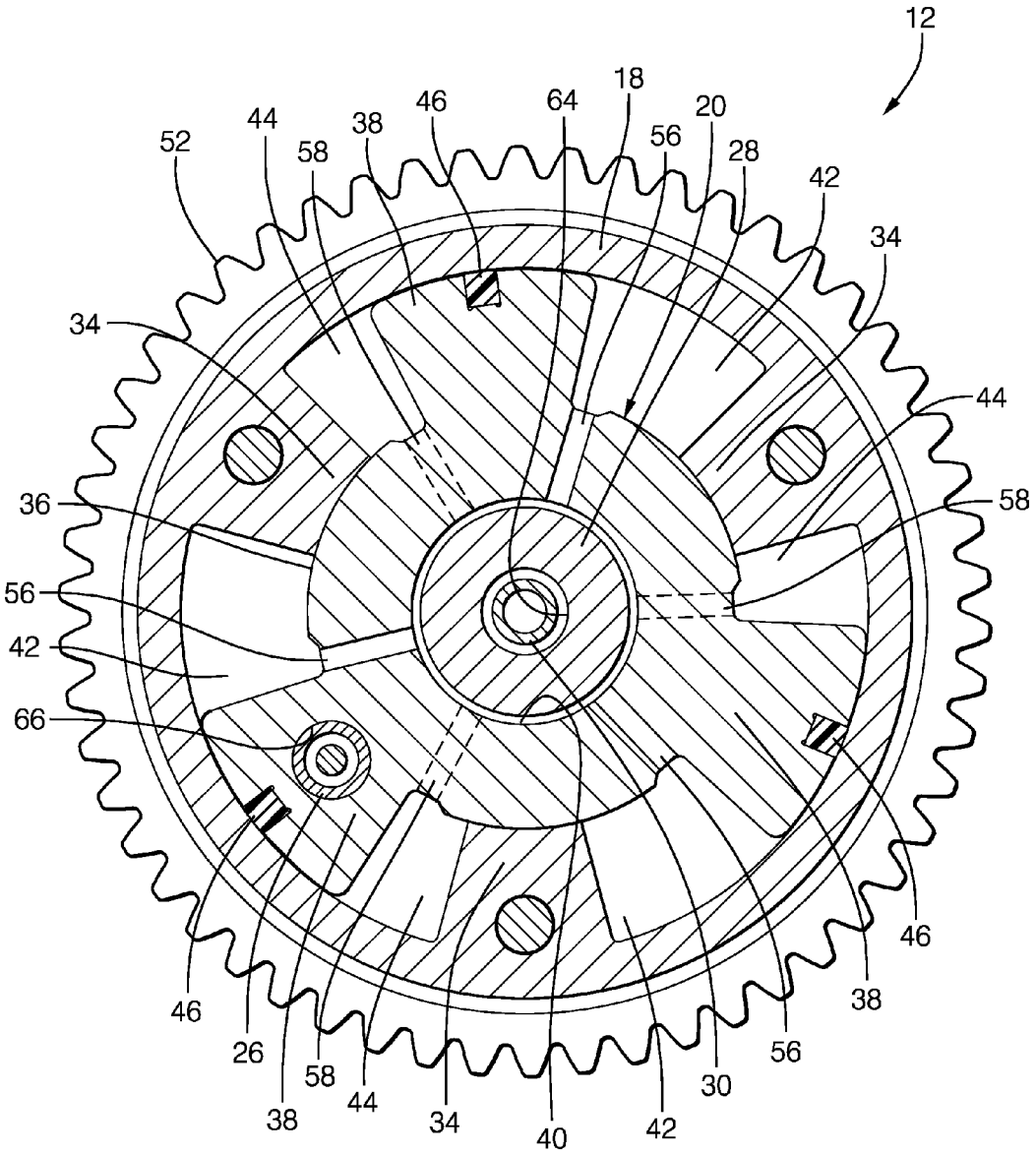
FIG. 2 is a radial cross-sectional view of the camshaft phaser in accordance with the present invention.
Figure 3:
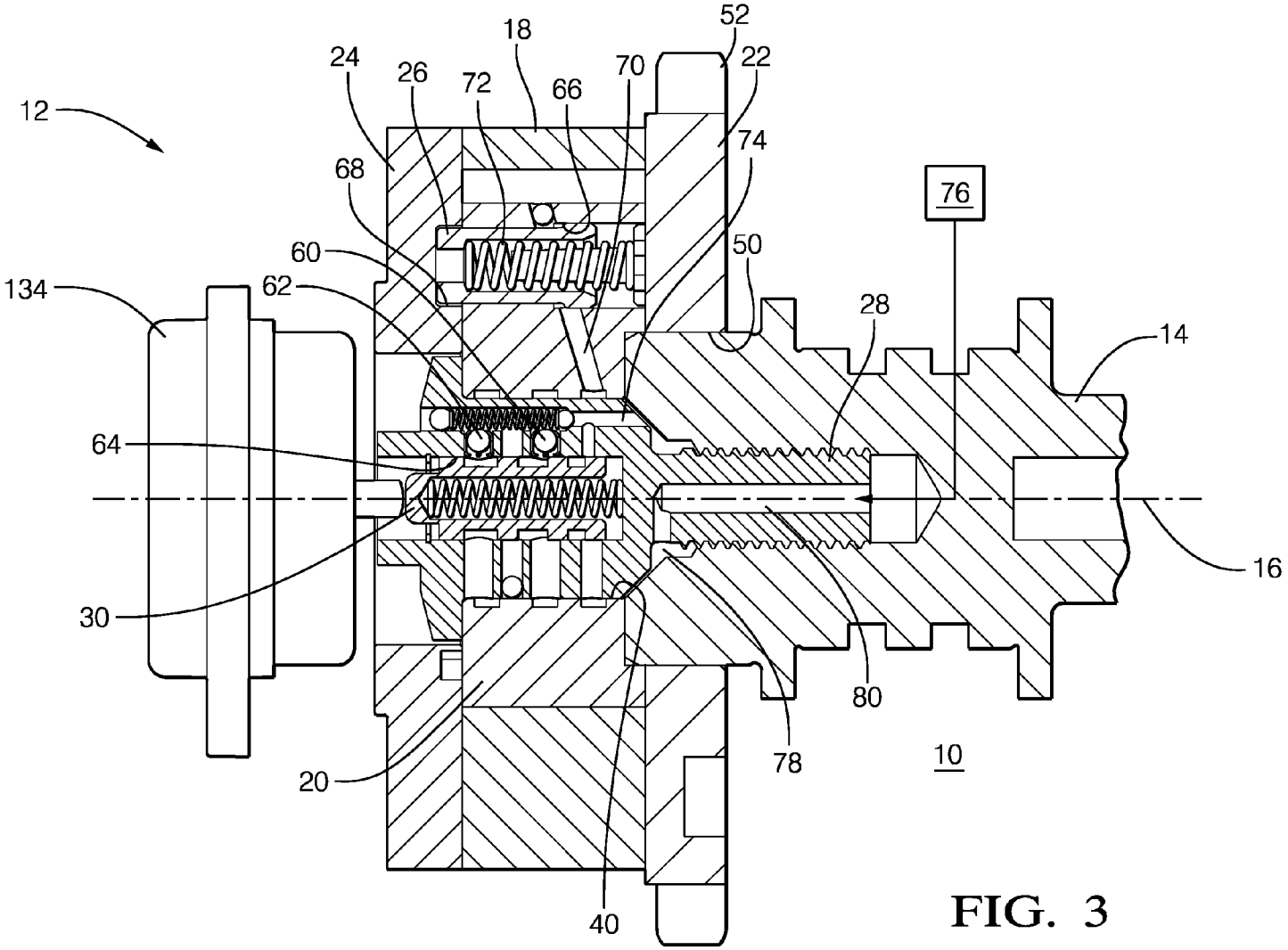
FIG. 3 is an axial cross-sectional view of the camshaft phaser in accordance with the present invention taken through a lock pin of the camshaft phaser.
Figure 4:
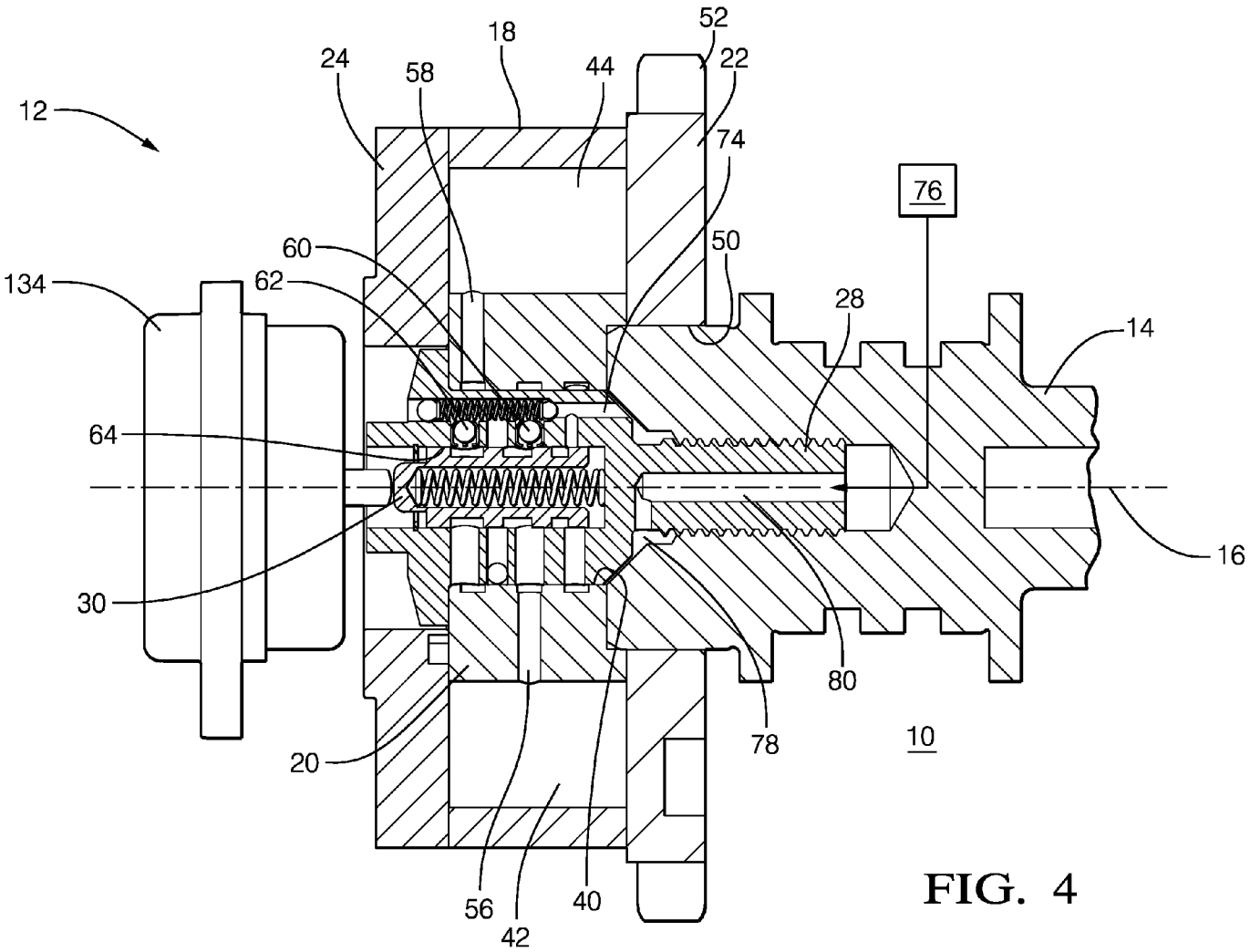
FIG. 4 is an axial cross-sectional view of the camshaft phaser in accordance with the present invention taken through advance and retard passages of a rotor of the camshaft phaser.

While camshaft phaser 12 has been described as defaulting to full advance, it should now be understood that camshaft phaser 12 may alternatively default to full retard by simply rearranging oil passages. Similarly, while full advance has been described as full clockwise rotation of rotor 20 within stator 18 as shown in FIG. 2, it should also now be understood that full advance may alternatively be full counterclockwise rotation of rotor 20 within stator 18 depending on whether camshaft phaser 12 is mounted to the front of internal combustion engine 10 (shown in the figures) or to the rear of internal combustion engine 10.

As described herein, advance check valve member 60 and retard check valve member 62 are biased toward advance check valve seat 98 and retard check valve seat 116 by centrifugal force caused by rotation of camshaft phaser 12 about camshaft axis 16 in use. As used herein, being biased by centrifugal force implies the absence of a mechanical biasing means, for example a spring, which is typically used to bias a check valve member toward a seat. Using centrifugal force rather than a mechanical biasing means allows for advantageous packaging which requires minimal space and can reduce the number of components which may lower assembly cost and assembly time.

In order to increase flow to achieve desired phasing rates, it should now be understood that duplicates of advance check valve member 60, retard check valve member 62, and related passages in camshaft phaser attachment bolt 28 may be provided.

While camshaft phaser 12 has been described herein as being of the cam torque actuated variety, it should now be understood that camshaft phaser 12 may alternatively be of the oil pressure actuated variety, i.e. pressurized oil from a source is supplied to the advance chambers or the retard chambers while oil is vented from the advance chambers and returned to the source if oil is supplied to the retard chambers and oil is vented from the retard chambers and returned to the source if oil is supplied to the advance chambers. When camshaft phaser 12 is of the oil pressure actuated variety, one of advance check valve member 60 and retard check valve member 62 may be omitted and the remaining check valve member is used as an inlet check valve member. The inlet check valve member operates on the same principle of being biased toward its seat by centrifugal force. Furthermore, supply check valve member 124 may be substituted with an inlet check valve which operates on the principle of being biased toward its seat by centrifugal force.

While this invention has been described in terms of preferred embodiments thereof, it is not intended to be so limited, but rather only to the extent set forth in the claims that follow.

We claim:

1. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft about an axis;

a rotor coaxially disposed within said stator, said rotor having a plurality of vanes interspersed with said lobes defining a plurality of alternating advance chambers and retard chambers;

a camshaft phaser attachment bolt for attaching said camshaft phaser to said camshaft, said camshaft phaser attachment bolt defining a valve bore that is coaxial with said stator;

a supply passage extending radially outward from said valve bore, said supply passage having a supply passage downstream end that is proximal to said valve bore and a supply passage upstream end that is distal from said valve bore, said supply passage downstream end and said supply passage upstream end being separated by a check valve seat;

a check valve member in said supply passage which prevents flow of oil past said check valve seat from said supply passage downstream end to said supply passage upstream end while allowing flow of oil past said check valve seat from said supply passage upstream end to said supply passage downstream end, wherein said check valve member is biased toward said check valve seat by centrifugal force; and a valve spool moveable within said valve bore such that said valve spool directs oil that has passed through said supply passage to said valve bore.

2. A camshaft phaser as in claim 1 wherein said supply passage is a bolt advance supply passage, said supply passage downstream end is a bolt advance supply passage downstream end, said supply passage upstream end is a bolt advance supply passage upstream end, said check valve member is an advance check valve member, and said check valve seat is an advance check valve seat, said camshaft phaser further comprising:

a bolt retard supply passage extending radially outward from said valve bore, said bolt retard supply passage having a bolt retard supply passage downstream end that is proximal to said valve bore and a bolt retard supply passage upstream end that is distal from said valve bore, said bolt retard supply passage downstream end and said bolt retard supply passage upstream end being separated by a retard check valve seat; and a retard check valve member in said bolt retard supply passage which prevents flow of oil past said retard check valve seat from said bolt retard supply passage downstream end to said bolt retard supply passage upstream end while allowing flow of oil past said retard check valve seat from said bolt retard supply passage upstream end to said bolt retard supply passage downstream end, wherein said retard check valve member is biased toward said retard check valve seat by centrifugal force;

wherein said valve spool directs oil to and from said bolt advance supply passage and said bolt retard supply passage.

3. A camshaft phaser as in claim 2 wherein:

said valve spool is moveable between an advance position and a retard position;

said advance position allows oil to flow through said retard check valve seat from said plurality of advance chambers to said plurality of retard chambers while preventing oil from flowing from said plurality of retard chambers to said plurality of advance chambers in order to advance the timing of said camshaft relative to said crankshaft; and wherein said retard position allows oil to flow through said advance check valve seat from said plurality of retard chambers to said plurality of advance chambers while preventing oil from flowing from said plurality of advance chambers to said plurality of retard chambers in order to retard the timing of said camshaft relative to said crankshaft.

4. A camshaft phaser as in claim 3, said camshaft phaser further comprising:

a bolt supply passage in said camshaft phaser attachment bolt; and a bolt recirculation passage extending from said valve bore to said bolt supply passage;

wherein said advance position allows oil to flow through said bolt recirculation passage from said plurality of advance chambers to said plurality of retard chambers; and wherein said retard position allows oil to flow through said bolt recirculation passage from said plurality of retard chambers to said plurality of advance chambers.

5. A camshaft phaser as in claim 4 where said bolt recirculation passage is axially between said bolt advance supply passage and said bolt retard supply passage.

6. A camshaft phaser as in claim 4 further comprising a bolt advance passage extending radially outward from said valve bore such that said bolt advance passage is in fluid communication with said plurality of advance chambers and such that said bolt advance passage diametrically opposes said bolt advance supply passage.

7. A camshaft phaser as in claim 6 further comprising a bolt retard passage extending radially outward from said valve bore such that said bolt retard passage is in fluid communication with said plurality of retard chambers and such that said bolt retard passage diametrically opposes said bolt retard supply passage.

8. A camshaft phaser as in claim 4 wherein said bolt supply passage receives pressurized oil from an oil source.

9. A camshaft phaser as in claim 8 further comprising a lock pin which selectively engages a lock pin seat, wherein pressurized oil supplied to said lock pin from said bolt supply passage causes said lock pin to retract from said lock pin seat to permit relative movement between said rotor and said stator and wherein venting oil from said lock pin allows said lock pin to engage said lock pin seat in order to prevent relative motion between said rotor and said stator at a predetermined aligned position.

10. A camshaft phaser as in claim 9 further comprising a bolt lock pin supply passage which extends from said valve bore to said bolt supply passage such that said valve spool selectively provides fluid communication from said bolt lock pin supply passage to said lock pin and such that said valve spool selectively prevents fluid communication from said bolt lock pin supply passage to said lock pin.

11. A camshaft phaser as in claim 10 further comprising a bolt lock pin passage which extends passage extending radially outward from said valve bore such that said bolt lock pin passage is in fluid communication with said lock pin and such that said bolt lock pin passage diametrically opposes said bolt lock pin supply passage.

12. A camshaft phaser as in claim 10 further comprising:

a supply check valve seat which divides said bolt supply passage into a bolt supply passage lock pin portion and a bolt supply passage phasing portion; and a supply check valve member which 1) seats with said supply check valve seat to prevent oil from flowing from said bolt supply passage phasing portion to said bolt supply passage lock pin portion and 2) unseats from said supply check valve seat to permit oil to flow from said bolt supply passage lock pin portion to said bolt supply passage phasing portion;

wherein said bolt lock pin supply passage is in constant fluid communication with said bolt supply passage lock pin portion; and wherein said bolt advance supply passage, said bolt retard supply passage, and said bolt recirculation passage are in constant fluid communication with said bolt supply passage phasing portion.

13. A camshaft phaser as in claim 12 wherein:

said bolt advance supply passage, said bolt retard supply passage, and said bolt recirculation passage are in fluid communication with said bolt supply passage lock pin portion when said supply check valve member is unseated from said supply check valve seat; and said bolt advance supply passage, said bolt retard supply passage, and said bolt recirculation passage are not in fluid communication with said bolt supply passage lock pin portion when said supply check valve member is seated with said supply check valve seat.

14. A camshaft phaser as in claim 12 wherein said supply check valve member is biased toward said supply check valve seat by a spring disposed within said bolt supply passage phasing portion.

15. A camshaft phaser as in claim 4 wherein said bolt supply passage is parallel with said valve bore.

16. A camshaft phaser as in claim 3 wherein:

said valve spool is moveable between a hold position in addition to said advance position and said retard position;

said hold position prevents oil from flowing from said plurality of advance chambers to said plurality of retard chambers; and said hold position prevents oil from flowing from said plurality of retard chambers to said plurality of advance chambers.

17. A camshaft phaser as in claim 4 wherein:

said valve spool is moveable between a hold position in addition to said advance position and said retard position;

said valve spool blocks said bolt recirculation passage in said hold position to prevent oil flow from said plurality of advance chambers to said plurality of retard chambers through said bolt recirculation passage; and said valve spool blocks said bolt recirculation passage in said hold position to prevent oil flow from said plurality of retard chambers to said plurality of advance chambers through said bolt recirculation passage.

18. A camshaft phaser as in claim 17 wherein:

said valve spool and said advance check valve member prevent oil flow out of said plurality of advance chambers in said hold position; and said valve spool and said retard check valve member prevent oil flow out of said plurality of retard chambers in said hold position.

19. A camshaft phaser as in claim 1 wherein said check valve member is captured within a check valve cage which prevents said check valve member from exiting said supply passage.

20. A camshaft phaser as in claim 19 wherein said check valve seat is defined by said check valve cage.

* * * * *